United States Patent [19]

Nakamura

[11] 4,349,186

[45] Sep. 14, 1982

[54] THIN SHEET FEEDING APPARATUS

[75] Inventor: Kunihiko Nakamura, Yokohama, Japan

[73] Assignee: Tokyo Shibaura Denki Kabushiki Kaisha, Kawasaki, Japan

[21] Appl. No.: 127,746

[22] Filed: Mar. 6, 1980

[30] Foreign Application Priority Data

Mar. 9, 1979 [JP] Japan ..... 54-27358
Dec. 13, 1979 [JP] Japan ..... 54-162027

[51] Int. Cl.[3] ..... B65H 3/46; B65H 1/18

[52] U.S. Cl. ..... 271/18; 271/30 R; 271/155; 271/161; 221/51; 414/416

[58] Field of Search ..... 271/161, 19, 20, 21, 271/22, 24, 25, 105, 209, 145, 169, 18, 155, 1, 8 R, 30 R, 147, 148, 166; 221/51, 43, 42, 45; 414/113, 118, 123, 416

[56] References Cited

U.S. PATENT DOCUMENTS

| | | | |
|---|---|---|---|
| 2,639,150 | 5/1953 | Aberle | 271/155 |
| 3,503,606 | 3/1970 | Castellanet | 271/166 |
| 3,578,314 | 5/1971 | Ward | 271/166 X |
| 3,684,276 | 8/1972 | Bridgeman | 271/20 |
| 4,005,794 | 2/1977 | Lundquist | 271/161 |

FOREIGN PATENT DOCUMENTS 2454082 5/1975 Fed. Rep. of Germany .

*Primary Examiner*—Bruce H. Stoner, Jr.
*Attorney, Agent, or Firm*—Oblon, Fisher, Spivak, McClelland & Maier

[57] ABSTRACT

A thin sheet feeding apparatus has a bending mechanism to curve a pile of thin sheets bundled by a belt member and a mechanism to sequentially feed at least one thin sheet from the uppermost thin sheet from the curved concave pile of the thin sheet in the predetermined feeding direction.

9 Claims, 17 Drawing Figures

THIN SHEET FEEDING APPARATUS

BACKGROUND OF THE INVENTION

1. Field of the Invention

This invention relates to a thin sheet feeding apparatus having means for supporting a pile of thin sheets bundled by a belt member; and means for sequentially feeding at least one thin sheet at a time from an uppermost thin sheet of the pile in a given direction of feeding.

2. Description of the Prior Art

In a conventional thin sheet feeding apparatus for feeding thin sheets singly and sequentially from a pile of thin sheets which is bundled by a belt member, it has been general practice to manually remove the belt member from each pile before the pile is supplied to the thin sheet feeding apparatus. This is because there has not been proposed a suitable apparatus which can feed thin sheets from the pile bundled by the belt member. However, since the manual removal of the belt member is time-consuming, resulting in a decrease in the speed of processing the thin sheets, development of a suitable thin sheet feeding apparatus has been desired.

SUMMARY OF THE INVENTION

An object of this invention is to provide a thin sheet feeding apparatus which can feed at least one thin sheets at a time and sequentially from a pile of thin sheets which is bundled by a belt member and which consists of a plurality of thin sheets, without the need to remove the belt member.

To achieve the above object, the thin sheet feeding apparatus of this invention includes a bending means for bending the pile of thin sheets on the supporting means, which thin sheet is located on the concave side of the pile.

In the thin sheet feeding apparatus of this invention, when the thin sheets are being fed, the pile is curved so that each two side faces of the thin sheets of the pile is in contact slightly with the belt body. Thus, the frictional force exerted on the uppermost thin sheet in feeding it is extremely small as compared to the case in which the thin sheet is fed without bending. Therefore, the uppermost thin sheet or sheets can be easily fed from the pile in the direction of feeding.

BRIEF DESCRIPTION OF THE DRAWINGS

Other objects and features of the invention will be apparent from the following description taken in connection with the accompanying drawings, in which.

DETAILED DESCRIPTION OF THE PREFERRED EMBODIMENTS

Figure 1:
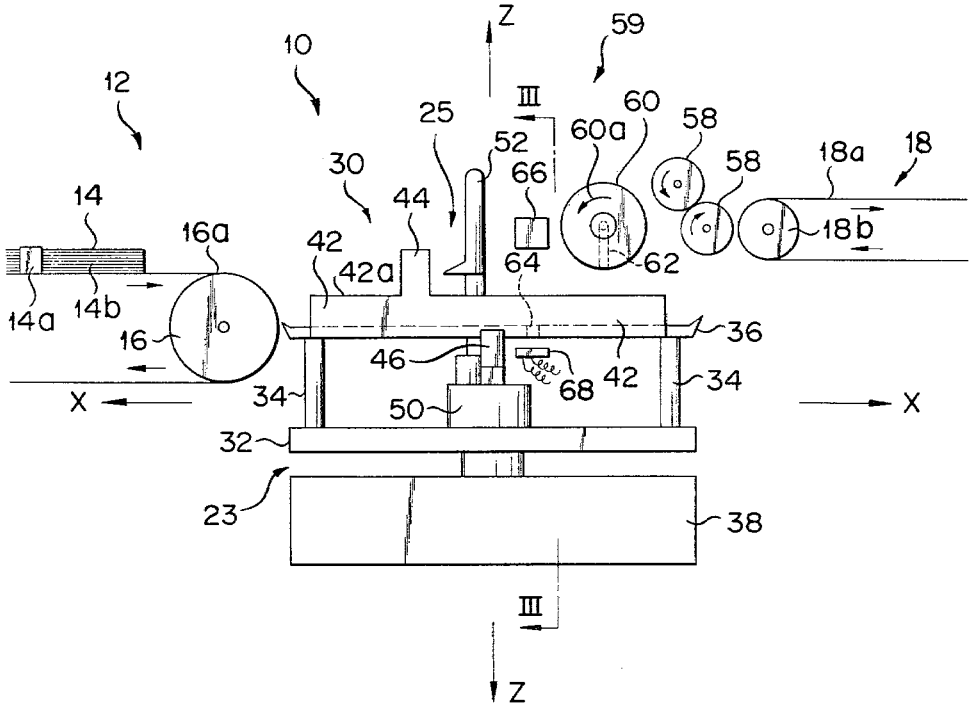
FIG. 1 is a front view of a first embodiment of this invention.

Embodiments of this invention will now be described. In FIG. 1, numeral 10 denotes a thin sheet feeding apparatus according to this invention and numeral 12 signifies a feeding means for transferring piles of thin sheets 14 (which will be hereinafter referred to as piles for brevity) to the feeding apparatus 10. The piles 14 comprise a plurality of thin sheets **14*b* which are boundled by belt members 14*a*. The piles 14 are supplied to the thin sheet feeding device 10 by a belt 16*a* driven by a roller 16 of the feeding means. Numeral 18 at the right end of FIG. 1 is a transferring means for transferring each thin sheet sequentially fed by the device 10 to the right direction by placing it on a belt 18*a*. The belt 18*a* is driven by a roller 18*b*. As indicated before, the piles 14 are supplied from the left side and are fed to the right side in FIG. 1. The left-right direction of FIG. 1 is referred to as the longitudinal direction and is shown by X—X in the Figure. The direction perpendicular to the X—X direction of FIG. 1 is referred to as the lateral direction and is shown by Y—Y in the Figure. The direction perpendicular to the X—X and Y—Y directions, that is, the vertical direction in FIG. 1**, is referred to as the vertical direction and is shown by Z—Z in the Figure. These symbols are shown in the drawings as needed.

Figure 2:
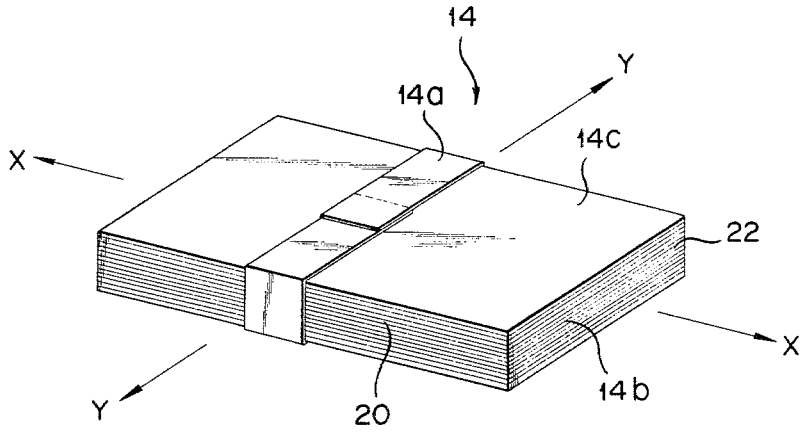
FIG. 2 is a perspective view of a pile of thin sheets used in the apparatus of FIG. 1.

FIG. 2 shows the pile 14. Each thin sheet **14*b* is substantially rectangular in shape, and a plurality of them are tightly bundled by a belt member 14*a*. The thin sheets described here in this specification include any flexible sheets such as bills, securities, documents and data cards consisting of resinous films. The pile 14 is kept, as shown in the Figure, in bundled form by a belt member 14*a* which lies along a direction substantially parallel to the shorter sides of the thin sheets, and the pile 14 is supplied to the device 10 in such a manner that their long sides are in the above-mentioned longitudinal direction. The pile 14 has side faces 20 perpendicular to the lateral direction and side faces 22 perpendicular to the longitudinal direction. The side faces 20 are referred to as longitudinal side faces, and the side faces 22, lateral side faces. They are, respectively, shown at 20 and 22**.

Figure 3:
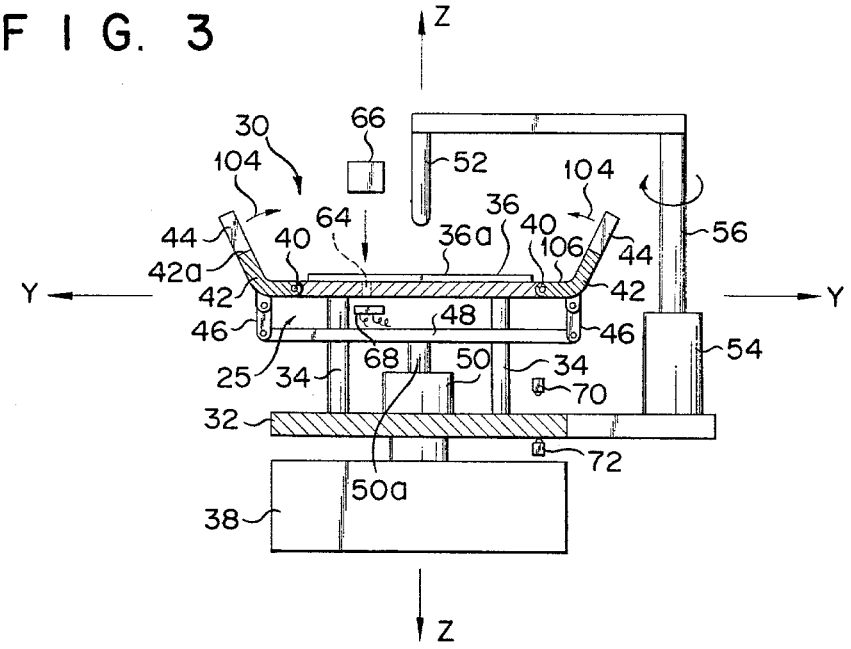
FIG. 3 is a side view of the apparatus of FIG. 1.

In FIGS. 1 and 3, a pile supporting means 23 for supporting the piles comprises a shifting means 30 for vertically moving the piles and a pile bending means 25 which will be described hereinafter in detail. The pile shifting means 30, as shown in FIG. 3, mainly includes a base plate 32; a support pole 34 standing upright thereon; a horizontal plate **36*a* of a carriage body 36, which is substantially horizontal to the support pole 34**;

and a vertically driving mechanism 38 for vertically shifting the base plate 32. The carriage body 36 has a horizontal plate 36*a* on which are placed the piles 14 supplied by the delivering means 12 and side plates 42 rotatably mounted at each of the lateral ends of the horizontal plate 36*a* through hinges 40. The side plates 42, respectively, extend laterally outward from each hinge 40 so that they open wider in the upward direction, and forming free ends 42*a*. Projections 44 extend from free ends 42*a* of the side plates 42 along the direction of extension of the side plates 42.

The lower ends of the side plates 42 are supported on the horizontal plate 36, and the side plates 42 are connected to a rod 48 through link mechanisms 46. The rod 48 is connected to an operating rod 50*a* of an electromagnetic mechanism 50 secured to the base plate 32. The pile bending means 25 comprises the side plates or sandwiching members 42, the link mechanism 46, the rod 48, the electromagnetic mechanism 50 and the operating rod 50*a*. A rod-shaped stopper 52 depends downward above the central part of the horizontal plate 36*a* as shown in FIG. 3. A vertically upright rotating mechanism 54 is mounted on the base plate 32 laterally away from the central portion of the horizontal plate 36*a*. A stopper supporting member 56 extends upwardly therefrom and then bends laterally, and from its front end depends the above-mentioned stopper 52. The rotating mechanism 54 comprises, for example, a pneumatic mechanism. When the rotating mechanism 54 is driven, the stopper 52 rotates about the vertical portion of the stopper supporting member 56, and stops at a position determined by a rotation interrupting member (not shown) of the mechanism 54. It is, however, automatically returned to the position shown in FIG. 3 by a spring (not shown) when the driving of the rotating mechanism is interrupted.

A suction roller 60 is disposed to the right of the stopper 52 and above the carriage body 36 in FIG. 1, and is rotated in the direction of an arrow 60*a* by a suitable driving means (not shown). A suction hole 62 is formed in this roller 60, one end of which is open at the central surface of the roller 60 and the other end of which is communicated with a suitable suction system (not shown) through the roller 60. A pair of mutually coupled feed rolls 58 are disposed to the right of the roller 60, and the roller 60 and the feed rolls 58 together form a thin sheet feeding means 59.

In FIGS. 1 and 3, numeral 64 denotes a hole formed in the horizontal plate 36*a*. A light emitter 66 and a light sensor 68 are disposed above and below the hole 64 so that they are in vertical alignment.

Numerals 70 and 72, shown above and below the base plate 32 (FIG. 3), are switching means or limit switches (70, 72) which are secured to the lift mechanism 38 and which operate when the base plate 32 reaches either a predetermined upper end position or a predetermined lower end position.

Figure 4:
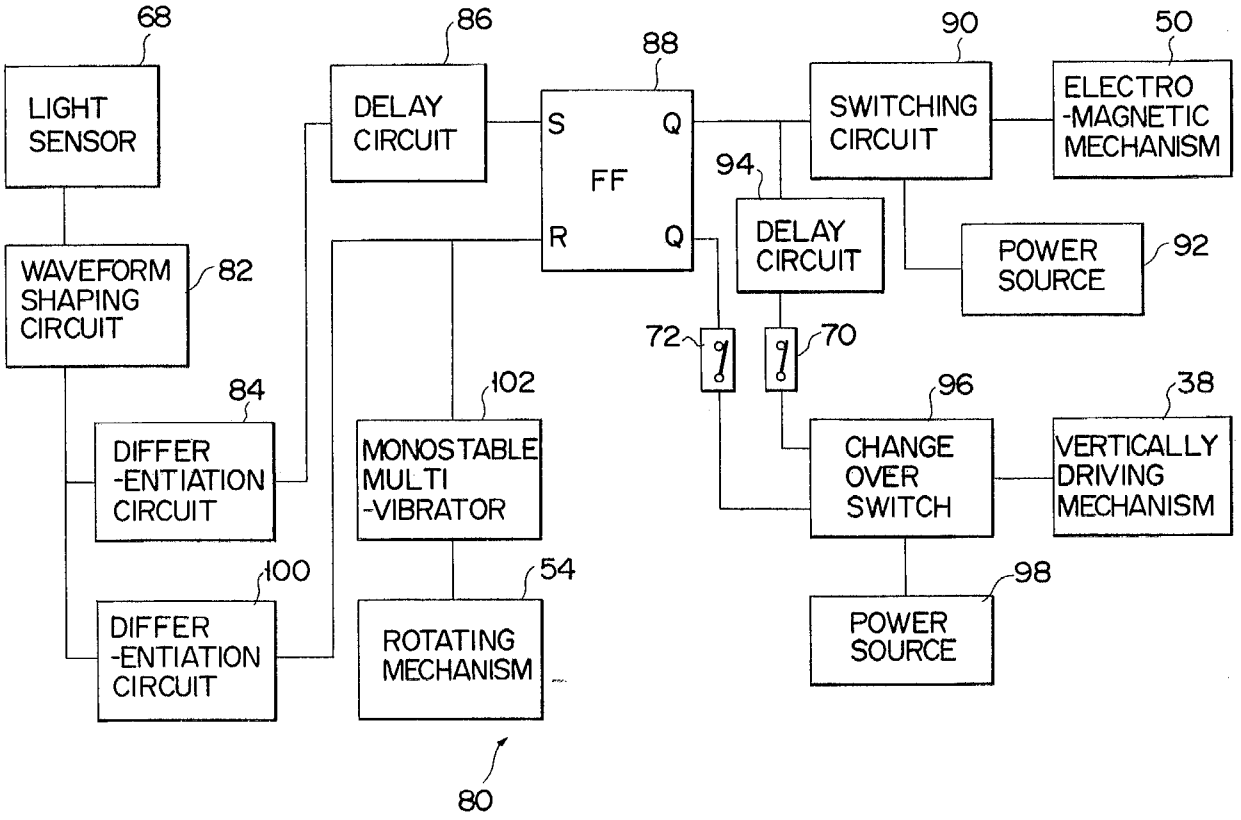
FIG. 4 is a block diagram of a control device for controlling the apparatus of FIG. 1.

A device 80 for controlling the vertically driving mechanism 38, the electromagnetic mechanism 50, and the rotating mechanism 54 will now be described with reference to FIG. 4. The control device 80 may take various forms and is well known to those skilled in the art. In addition, it does not constitute an essential feature of this invention. Thus, the explanation will be brief. An output signal of the light sensor 68 in FIG. 4 is supplied to a differentiation circuit 84 after it passed through a waveform shaping circuit 82. The falling signal of this output signal is supplied to the S terminal, that is, the setting terminal of a flip-flop circuit 88 (which will be referred to as an FF circuit) through a delay circuit 86. A setting output signal produced by the FF circuit 88 turns on a switching circuit 90, and the power of a power source 92 is applied to the electromagnetic mechanism 50 through the switching circuit 90. As indicated above, the setting output signal of the FF circuit 88 is applied to the switching circuit 90 and is also applied to a changeover switch 90 through a delay circuit 94 and the limit switch 70 (FIG. 3). The resetting output signal is also supplied to the change-over switch 96 through the limit switch 72 (FIG. 3). The limit switch 70 is kept on, except when it is turned off as the base plate 32 is lifted to a predetermined position to be operated. The limit switch 72 is kept on, except when it is turned off as the base plate 32 is lowered to another predetermined position to be operated. When the setting output signal of the FF circuit 88 is supplied through the limit switch 70, the change-over switch 96, utilizing the power supplied by another power source 98, drives the vertically driving mechanism 38 to lift the base plate 32 and interrupts its lifting when the limit switch 70 starts operating. When the resetting output signal of the FF circuit 88 is transmitted to the change-over switch 96 through the limit switch 72, the above-mentioned switch 96 drives the vertically driving mechanism 38 to lower the base plate 32 and interrupts its lowering when the limit switch 72 starts operating. Thus, the vertically driving mechanism 38 operates to lift the base plate 32 when a setting signal is produced by the FF circuit and the limit switch 70 is closed, and the vertically driving mechanism 38 operates to lower the base plate 32 when a resetting signal is produced by the FF circuit and the limit switch 70 is closed.

The output of the waveform shaping circuit 82 is supplied to the differentiation circuit 84 as well as to a differentiation circuit 100. The differentiation circuit 100 generates an output representative of a building up of the signal transmitted from the waveform shaping circuit 82 and supplies this signal to the resetting terminal of the FF circuit 88 and to monostable multivibrator 102. In response to the signal from the differentiation circuit 100, the monostable multivibrator 102 drives the rotating mechanism 54 for a predetermined period of time and transfers the stopper 52 (FIG. 3) from its position above the horizontal plate 36*a* for the above-mentioned predetermined period of time.

Figure 5:
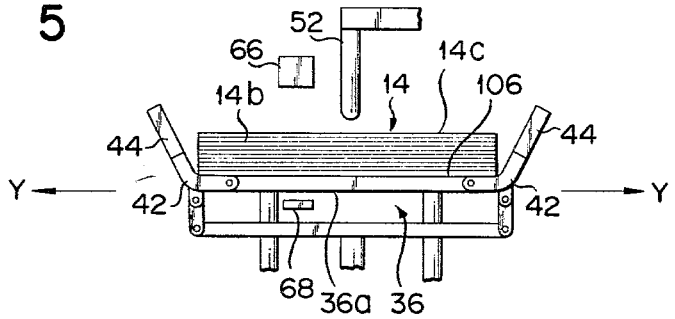
FIGS. 5 to 7 are side views illustrating the process of bending the pile.
Figure 6:
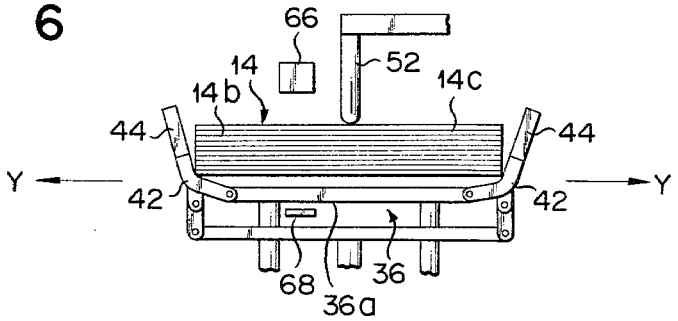
Figure 7:
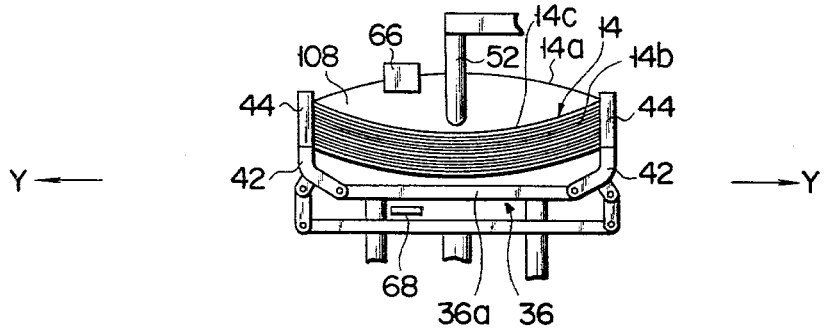
Figure 8:
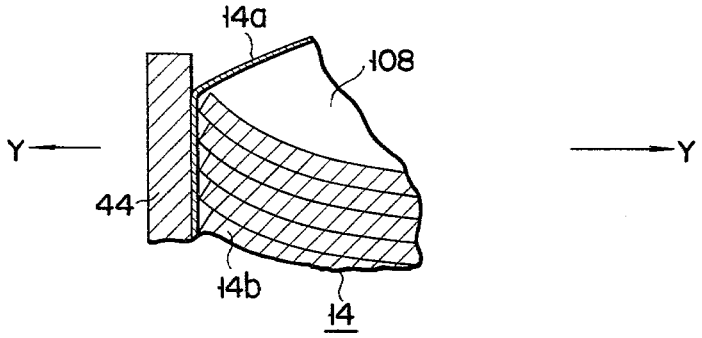
FIG. 8 is a side view illustrating the relation between the side faces of the bent pile and the belt member.
Figure 9:
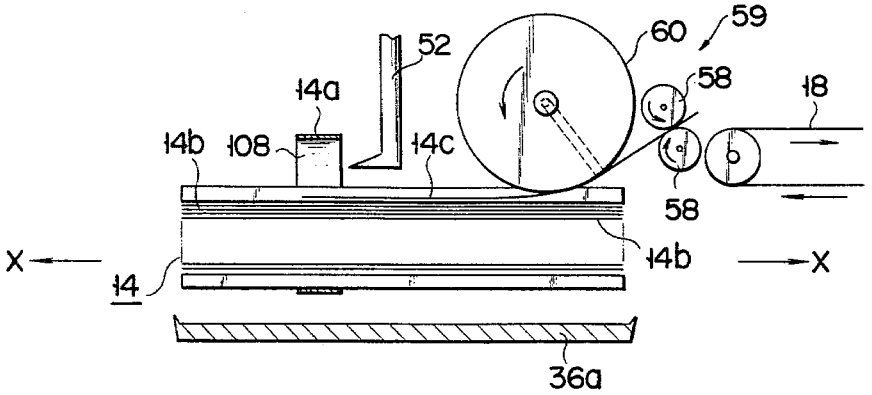
FIG. 9 is a front view illustrating how the bent pile is drawn by suction by a suction roller for feeding.

Next, the operation of this embodiment will be described. Assume that the lift mechanism 38 stays stationary at its lowest position, the limit switch 72 is off and the FF circuit is in its resetting condition. When the pile 14 is supplied to the device 10 in this condition by feeding means 12 and is placed on the carriage body 36 of the pile transferring means 30, the light emitted from the light emitter 66 is blocked by the pile 14 and the signal produced by the light sensor 68 is weakened. Thus, through the intermediation of the differentiation circuit 84 and the delay circuit 86, the FF circuit is placed under a setting condition, and the switching circuit 90 is turned on. As a result, the electromagnetic mechanism 50 is operated, the operating rod 50*a* is lifted, and the side plates 42 of the carriage body 36 are pivoted about the hinges 40 in the direction of the arrows 104 of FIG. 3. The width of the horizontal part 106 of the carriage body 36 is adjusted to be substantially equal to the width of the pile 14 as shown in FIG. 5. Also, the upper surfaces of the side plates 42 are, as described before, curved to form gently curved faces. Thus, as the side plates 42 are pivoted, the pile 14 is lifted while slipping along the curved faces, as shown in FIG. 6. When the pile 14 is lifted to the predetermined position, the center of the upper surface of the pile 14 contacts the lower end of the stopper 52. As the side plates are pivoted further, the pile 14 is lifted still further along the projections 44. However, since the stopper 52 inhibits the lifting of the center of the upper surface, the right and left ends of the pile 14 of FIG. 6 alone are lifted along the projections 44. The pile 14 thus takes a bent form, facing its recessed side upwardly as shown in FIG. 7. That is, the pile 14 as a whole is curved as mentioned above as its longitudinal side faces 20 are clamped by the projections 44, and the belt member 14*a* is bent in an arc forming a convex surface at its upper side. Thus, a space 108 similar to the shape of a convex lens is formed between the belt member 14*a* and the upper surface of the pile 14. Shown in FIG. 8 are the left ends of the thin sheets 14*b* constituting the pile 14 in the condition shown in FIG. 7. Although the lower surface of the bottommost thin sheet is in contact with the belt member 14*a*, the other thin sheets contact the belt member 14*a* at the lower edges of their thin side faces. Accordingly, the pressing force of the belt member 14*a* which has been applied concentratedly to the upper portion and lower portions of the side faces of the pile 14 is diffused in the substantially whole areas by which the belt member 14*a* contacts with the both side faces of the bent pile. Thus, the frictional force between the thin sheets and the belt member 14*a* becomes substantially the same as when the thin sheets are not bundled by the belt member 14*a*. Therefore, the uppermost thin sheet can easily be taken out with a small force when pulled in the longitudinal direction, that is, in the direction perpendicular to the plane of the thin sheets of FIG. 7. Thereafter, when a period of time determined by the delay circuit 94 elapses, a lift control signal for lifting the base plate 32 is supplied to the change-over switch 96 through the limit switch 70. The carriage body 36 is then lifted with the base plate 32 to a predetermined position wherein the roller 60 contacts the uppermost thin sheet 14*c* of the pile in the condition of FIG. 7. The thin sheet 14*c* is longitudinally displaced by the roller, is engaged with the feed rolls 58 of FIG. 9 to be transferred upwardly to the right, and is fed to a desired position through the transferring means 18. The roller 60 and the feed rolls 58 constitute the thin sheet feeding means for pulling the thin sheets from the pile 14.

As the thin sheets 14*b* come to the last sheet from the uppermost thin sheet 14*c*, the output signal of the light sensor 68 is strong again. In response to the output signal of the differentiation circuit 100, the FF circuit 88 is placed under a resetting condition. When the FF circuit 88 is reset, the switching circuit 90 is turned off, the force exerted by the electromagnetic mechanism 50 is released, and the carriage body 36 is returned to the position shown in FIG. 5. Further, as the FF circuit 88 is reset, a lowering control signal is supplied from the change-over switch 96 to the vertically driving mechanism 38. As a result, the base plate 32 lowers until the limit switch 72 is turned off and the operation of the vertically driving mechanism 38 is interrupted. The output signal of the differentiation circuit 100 is also supplied to the monostable multivibrator 102 for a predetermined period of time for inverting it. As a result, a valve in the rotating mechanism 54 opens, and compressed air supplied therethrough displaces the stopper 52 of FIGS. 1 and 3 from the center of the horizontal plate 36*a*. Then, the belt member 14*a* remaining on the carriage body 36 is hooked by the lower end of the stopper 52 to be laterally displaced, and is made to fall from the stopper 52 when the stopper 52 is abruptly interrupted by another stopper (not shown) in the rotating mechanism. After a predetermined time, the above-mentioned valve is automatically closed. The stopper then returns to the position shown in FIGS. 1 and 3 by the restoring force of a spring (not shown) in the rotating mechanism 54. As a next pile 14 is supplied by the feeding means 12, the above series of operations is repeated and the thin sheets are sequentially fed by this apparatus.

Figure 10:
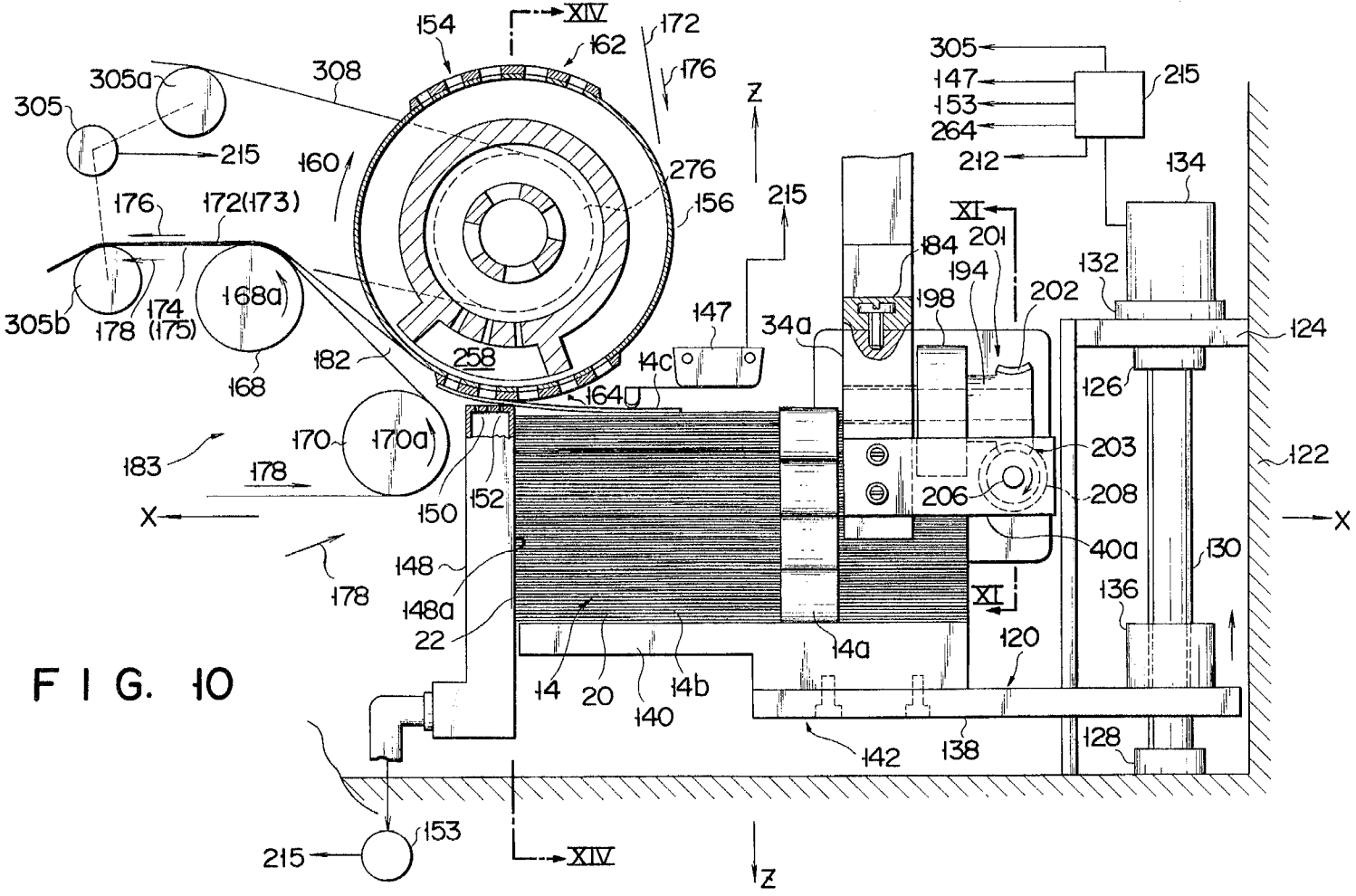
FIG. 10 is a front view of a second embodiment of this invention.

A second embodiment of the apparatus of this invention will now be described. FIG. 10 is a side view illustrating the main part of the thin sheet feeding apparatus of the second embodiment. Numeral 122 refers to a frame of the apparatus 120. Bearings 126 and 128 are mounted through a support member 124 on the frame 122 in alignment with the Z—Z direction, that is, in vertical alignment. A vertically extending screw rod 130 is received by the bearings 126 and 128. The upper end of the screw rod 130 is connected to a motor 134 through a decelerating mechanism 132. A vertically movable nut 136 is connected to the screw rod 130, to which, in turn, is secured a connecting member 138 and a thin sheet holding base 140. The holding base 140 is vertically moved by the motor 134. The pile transferring means 120 (FIG. 11), having the motor 134, the decelerating mechanism 132, the screw rod 130, the nut 136, the connecting member 138, and the holding base 140, together with a bending means 201 to be described hereinafter, constitute the pile supporting means 142.

The connecting means 138 and the holding base 140 are substantially flat and extend in the left-right direction, that is, the longitudinal X—X direction of FIG. 10. A plurality of piles 14 (FIG. 2) are vertically superposed on the holding base 140 in the Z—Z direction. The pile is placed so that its longitudinal direction, that is, the X—X direction of FIG. 2 is aligned with the above-mentioned longitudinal direction. A direction perpendicular to both the X—X direction and the Z—Z direction, that is, the direction perpendicular to the plane of the thin sheets of FIG. 10, will be referred to as the lateral direction and will be shown as the Y—Y direction. A position detector 147, for example a limit switch, is disposed above the holding base 140. When the uppermost thin sheet 14*c* of the pile 14 placed on the holding base 140 is lifted to a position detectable by the position detector 147, the position detector 147 generates an off signal which cuts off the power supply to the motor 134 to stop it. When the thin sheet 14*c* is at a lower position in which the position detector 147 is not operable, the position detector generates an on signal which causes the motor 134 to rotate, continuously lifting the pile 14. As a result, the uppermost thin sheet 14*c* is held at a constant position.

Figure 11:
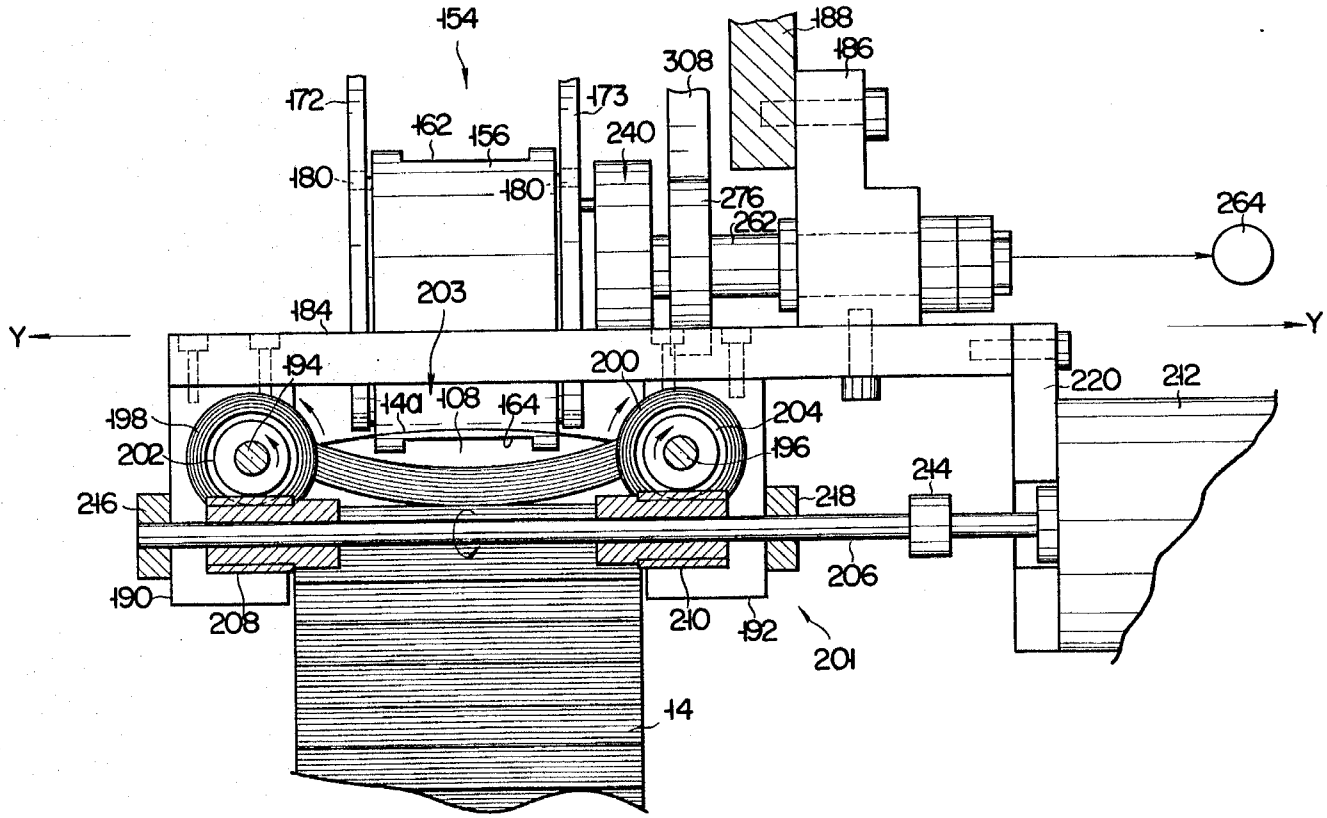
FIG. 11 is a partial sectional side view illustrating the main part of the apparatus of FIG. 10.
Figure 12:
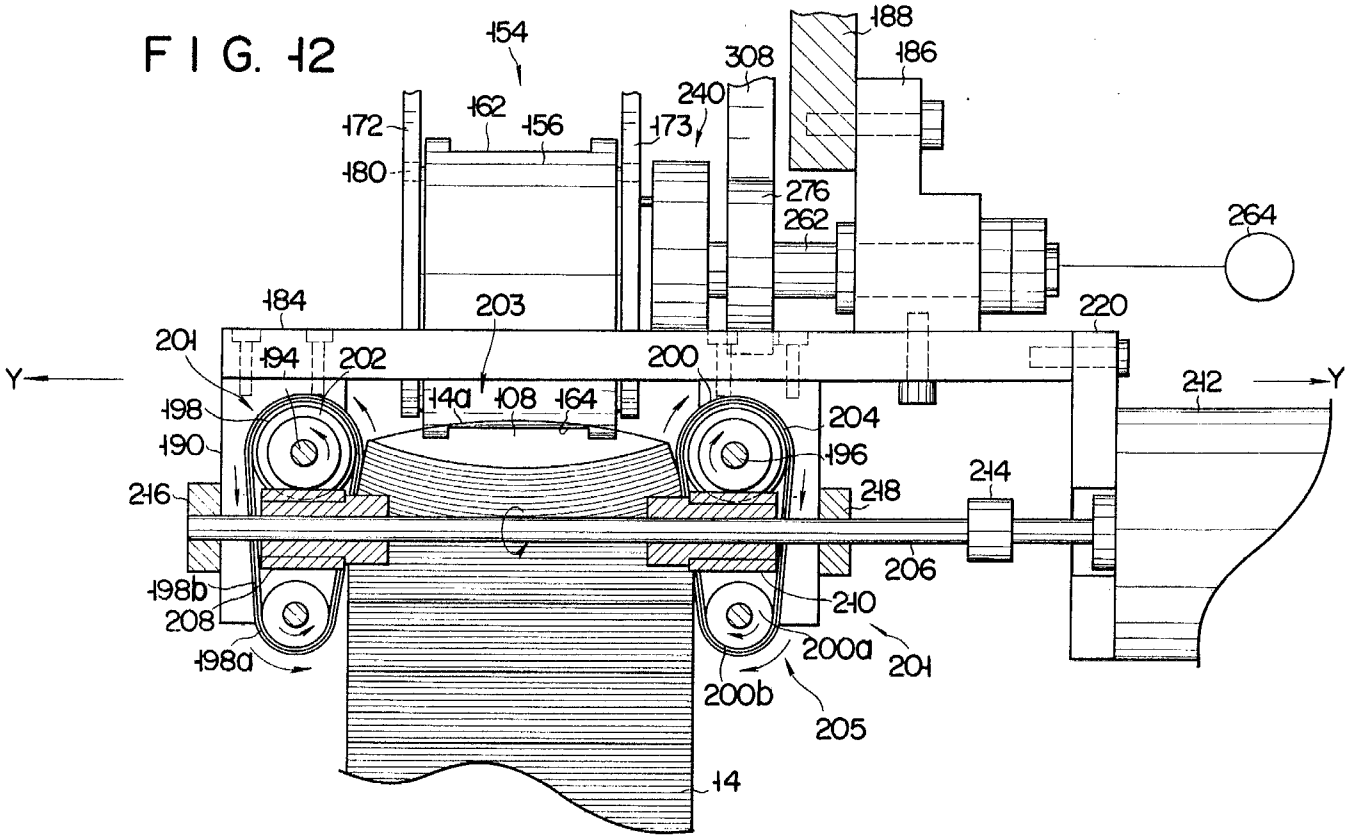
FIG. 12 is a partial sectional side view illustrating the main part of a third embodiment of this invention.
Figure 13:
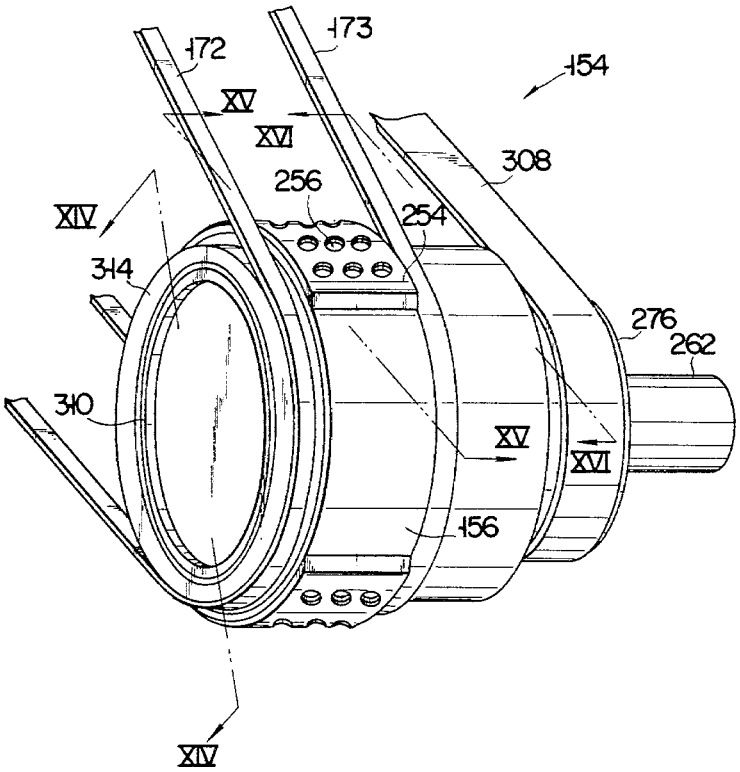
FIG. 13 is a perspective view of the thin sheet feeding means used in the second embodiment shown in FIGS. 10 and 11.
Figure 14:
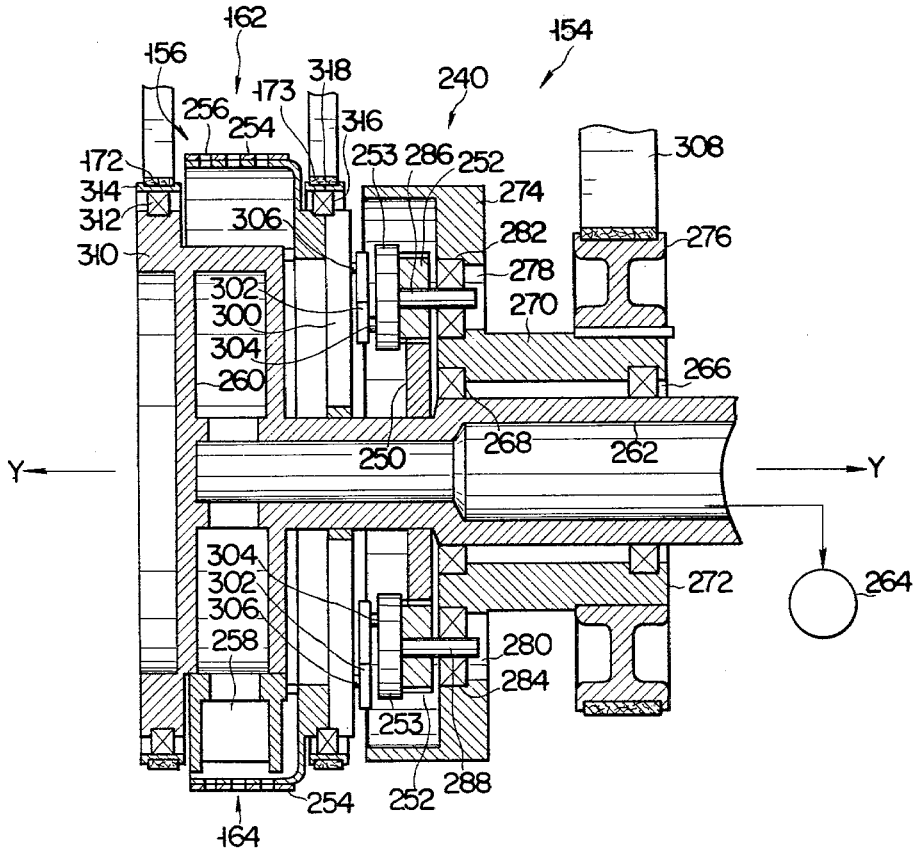
FIG. 14 is a sectional view incorporating a rotational axis of the means of FIG. 13.

A suction cylinder 148 of substantially rectangular shape is mounted on the frame 122 to the left of the holding base 140 of FIG. 10. The right end face of the suction cylinder 148 (FIG. 10) is so shaped that the left side face 146 of the pile 14 is substantially vertical. Suction holes 152 are bored through the upper plate 150 in an arrangement mentioned below for taking in outside air. The taking in of the outside air is performed by a suction pump 153 connected to the lower part of the suction cylinder 148. The upper surface of the plate 150 is at substantially the same level as the uppermost thin sheet 14*c* of the pile 14 placed on the holding base 140. The suction holes 152 are formed in a matrix form: a, in number, in the longitudinal direction and b, in number, in the lateral direction. The function of the suction holes 152 will be described hereinafter. The specific values for a or b are determined for each apparatus and are typically a=3 and b=5. A thin sheet feeding means 154 is disposed in the vicinity of the upper part of the suction cylinder 148. Since the thin sheet feeding means 154 has a complex structure, its main part is shown in FIGS. 10, 11 and 12 and the detail is shown in FIGS. 13, 14, 15 and 16. The rotary axis of a rotary drum 156 of the thin sheet feeding means 154 is in the lateral direction as shown in FIG. 10, and the drum is intermittently rotated in the direction of the arrow 160. Openings 162 and 164 are formed on the circumferential wall of the rotary drum 156 and are 180° apart from each other. A stationary suction nozzle 258 is disposed inside the rotary drum 156 and is open near the inner circumferential face of the rotary drum 156. The suction nozzle 258 is connected to a suction pump 264 (FIG. 11, FIG. 14). Laterally extending rollers 168, 305*b* and a roller 170 are disposed to the left of the rotary drum 156 and the suction cylinder 148 (FIG. 10). Two belts 172 and 173 (FIGS. 11 and 13) are made to run respectively, at both lateral ends of the rotary drum 156, the rollers 168 and 305*b* in the direction of the arrow 176. Belts 174 and 175 are made to run over the rollers 168, 170 and 305*b* in contact with the belts 172 and 173 respectively. The belts 172, 173, 174 and 175 are shifted respectively, in the directions of the arrows 176 and 178 by a motor 305 and the thin sheet feeding means 154. The rotary drum 156 is rotated in the direction of the arrow 160, and the guide rolls 168, 170 are rotated in the directions of the arrows 168*a* and 170*a*. A bearing 180 is mounted on each lateral end of the rotary drum 156 as shown in FIG. 11 and the belts 172 and 173 are disposed over the outer race of the bearings 180 each having a diameter smaller than that of the rotary drum 156. Numeral 182 in FIG. 10 refers to a clamping port which is formed between belts 172 and 173, and the belts 174, 175 and which clamps the uppermost thin sheet 14*c* drawn by suction by the rotary drum 156 and feeds it to the transferring means 183 with the belts 172 and 173 and the rollers 168, 170 and 305*b* for transferring the thin sheet to a predetermined position.

A laterally extending supporting member 184 is mounted to the frame 122 (FIG. 10) to the right of the thin sheet holding base 140 by members 186 and 188, as shown in FIG. 11. Holding blocks 190 and 192 protrude from each lateral end of the supporting member 184 and receive, respectively, longitudinally extending shafts 194 and 196. Rollers 198 and 200, of a material with a great surface frictional resistance such as rubber, are securely mounted on the shafts 194 and 196, respectively. The rollers 198 and 200 are so disposed that the minimum space between their outer circumferences is slightly shorter than the lateral length of the pile 14. The portion of the minimum space is disposed at substantially the same vertical level as the uppermost thin sheet 14*c* determined by the position detector 147. Worm wheels 202 and 204 are, respectively, mounted on the shafts 194 and 196 and are engaged with worms 208 and 210 mounted on the same shaft 206. The teeth of the worms 208 and 210 are twisted in opposite directions. When the shaft 206 is driven in a clockwise direction as taken from the left of FIG. 11 through a coupling 214 by a motor 212 mounted on the supporting member 184, the worm wheels 202 and 204 are rotated, respectively, in the counterclockwise and clockwise directions as shown in FIG. 11. The shaft 206 is received by the bearing members 216 and 218, each secured to the holding blocks 190 and 192. The rotational speed of the motor 212 is so adjusted that the rollers 198 and 200 rotate at a circumferential speed faster than the lifting speed of the thin sheet holding base 140 lifted by the motor 134. The motors 134 and 212 may be started, stopped or reversed at desired times by a separate control device 215. The control device 215 controls the rotation of the motors 134 and 212 and a motor 305 to be described hereinafter, and it also controls the rotation of suction pumps 153 and 264.

Figure 15:
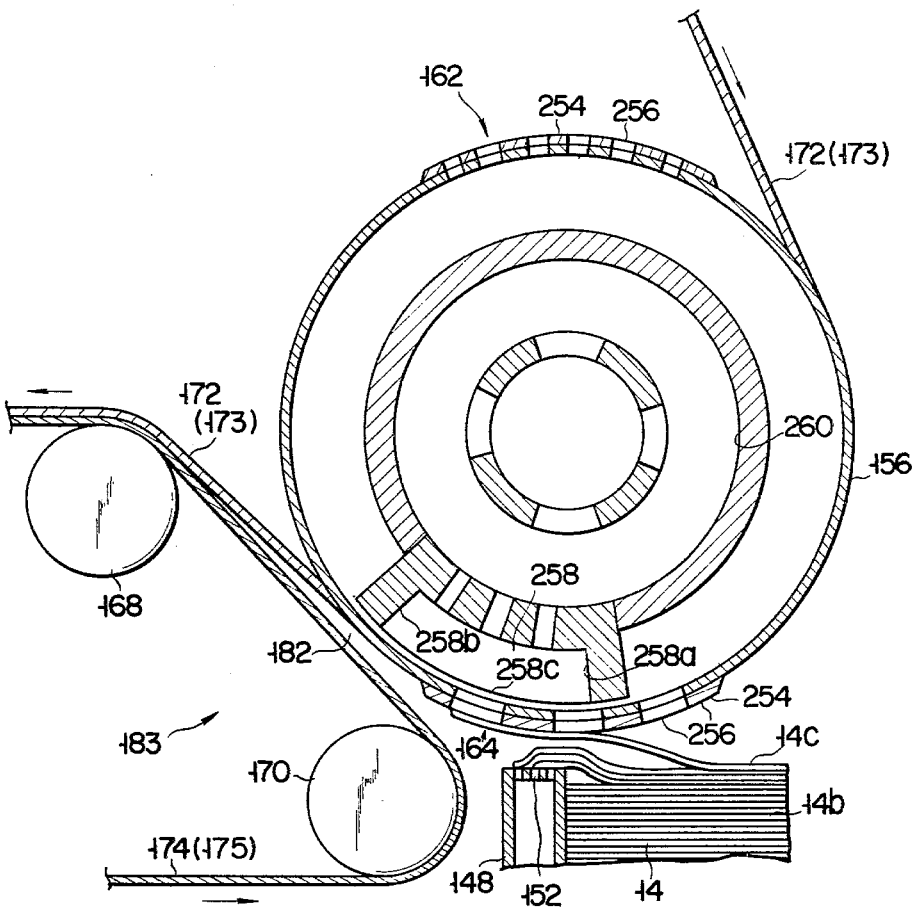
FIG. 15 is a view illustrating the thin sheet feeding function of the means of FIG. 13.

A thin sheet feeding means 154 will now be described which feeds the uppermost thin sheet 14*c* of the pile 14. FIG. 13 is a perspective view of the feeding means 154 of FIG. 10, and FIG. 14 is a sectional view of the feeding means 154 along the line XIV—XIV of FIG. 10 illustrating only its main part. The rotary drum 156 of the thin sheet feeding means 154 has a width smaller than the lateral width of the thin sheets, and its diameter is determined to be $n(n+2)/2\pi(n+1)L$ where n is the ratio of the pitch circles of a sun gear 250 and planet gears 252 and L is the taking out pitch of the thin sheets 14*c* (FIGS. 11 and 12). The openings 162 and 164 of the rotary drum 156 are formed as follows. Rectangular members 254 of a material having great surface friction, such as rubber, are mounted on the rotary drum 156 substantially 180° away from each other. A plurality of suction holes 256 are formed through these members and the circumferential wall of the rotary drum 156. A suction nozzle 258 is secured inside the rotary drum 156 so that its opening 258*c* is in the vicinity of the inner circumference of the rotary drum 156, as shown in FIGS. 14 and 15. The circumferential width of this opening 258*c* is determined by walls 258*a* and 258*b* shown in FIG. 15. The face of the wall 258*a* at the side of the wall 258*b* is disposed horizontally about 3–8 mm to the right of the left end of the pile 14 (FIG. 15). The face of the wall 258*b* at the side of the wall 258*a* is so arranged to the left of the suction cylinder 148 of FIG. 15 that the uppermost thin sheet 14*c* is drawn by suction to the rotary drum until it has accomplished a predetermined acceleration in accordance with the rotation of the rotary drum 156. The walls 258*a* and 258*b* are radially upright from a hollow annular body 260 formed in and coaxial with the rotary drum 156. A hollow stationary shaft 262 extends laterally from the hollow annular body 260, as shown in FIG. 14. The hollow stationary shaft 262 extends through the member 186 mounted on the supporting member 184 to be secured to the member 186, and the inner hollow space in the hollow shaft 262 communicates with a suction pump 264 through a pipe, shown at the right of FIGS. 11, 12 and 14.

Figure 16:
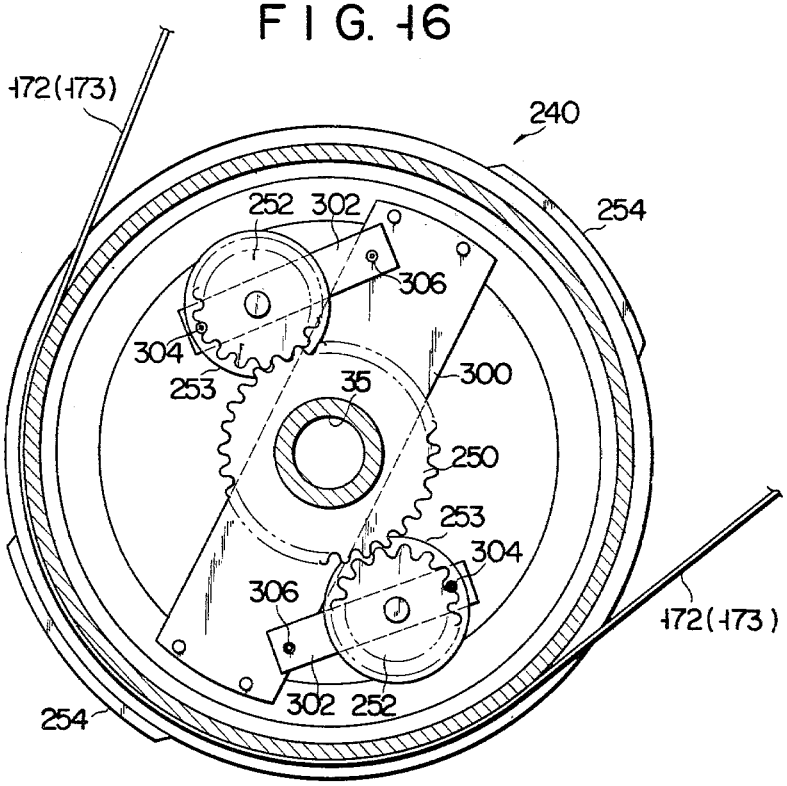
FIG. 16 is a view illustrating the differential gear portion of the means of FIG. 13.

A housing 270 is rotatably mounted on the outer circumference of the hollow stationary shaft 262 through bearings 266 and 268 as shown in FIG. 14. The housing 270 has a cylinder 272 and a collar 274 formed at the side end of the rotary drum 156 of the cylinder. A pulley 276 is keyed to the outer circumference of the cylinder 272. Holes 278 and 280 are formed in the collar 274, separated by 180°. Shafts 286 and 288 are, respectively, received by bearings 282 and 284 which are inserted in the holes 278 and 280 respectively. Planet gears 252 are mounted on the outer circumferences of each of the shaft 286 and 288, and they engage with the sun gear 250 which is mounted on the hollow stationary shaft 262 and which, together with these planet gears 252, forms a differential gear 240. A disk 253 is mounted at the left ends of the shafts 286 and 288 of FIG. 14. A substantially rectangular end plate 300 is mounted at the right end face of the rotary drum 156, as shown in FIGS. 14 and 16. Numeral 302 denotes rectangular connecting plates which are attached at one end, to the periphery of the disk 254 by pins 34, and which are attached, at the other end, to the ends of the end plate 300 by pins 306. The number of teeth on the planet gears 252 is half that of the sun gear 250. When the housing 270 is rotated by a belt 308 through the pulley 276, the planet gears 252 are designed to revolve around the sun gear 250 as they rotate about their rotational axes, and to rotate the rotary drum 156 as described below. When one of the suction holes of the rotary drum 156, advanced in the direction of rotation, reaches a position above the left end of the pile (FIG. 15), the rotation of the rotary drum 156 is interrupted. Then, those suction holes 256 formed in the rotary drum 156 which are displaced to the front face of the suction nozzle 258 are located 3–8 mm beyond the wall 258*a* of the suction nozzle 258. The rotary drum 156 is interrupted temporarily in its rotation twice during one revolution. Once its rotation is interrupted, it gradually accelerates and reaches its maximum speed at the midway point, then decelerates and reaches the next temporary interruption point. A ringshaped protruding wall 310 of diameter smaller than that of the rotary drum 156 protrudes to the left of the rotary drum from the left end of the hollow annular body 260. A bearing 312 and a guide pulley 314 are disposed outwardly of the outer circumference of the wall 310. A bearing 316, similar in size to the bearing 312, and a guide pulley 318 are disposed outside the right end of the rotary drum 156 (FIG. 14). Endless belts 172 and 173 are, respectively, disposed outside the guide pulleys 314 and 318. The endless belts 172, 173, 174 and 175 and the belt 308 are driven by the pulleys 305*a* and 305*b* which are driven by the motor 305 (FIG. 10). The belts 172, 173, 174 and 175, the pulleys 168 and 170, and the pulley 305*b* driven by the motor 305 constitute the transferring means 183 for feeding thin sheets.

Figure 17:
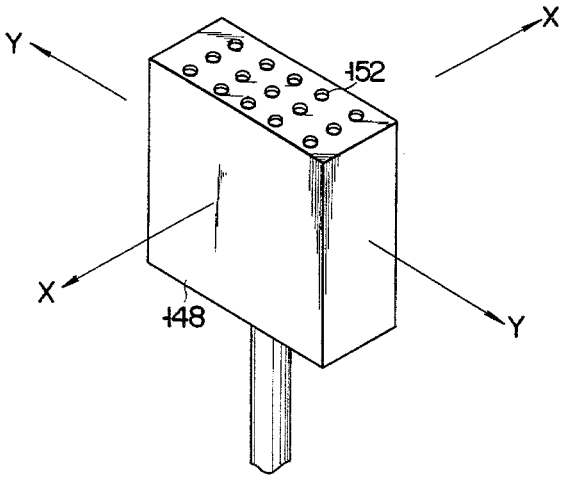
FIG. 17 is a perspective view illustrating an example of an arrangement of suction holes formed in a suction cylinder.

The operation of the thin sheet feeding means 154 will now be described. First, the motor 305 is driven for driving the transmission belt 308 and the belts 172, 173, 174 and 175 through the pulleys 305*a* and 305*b* and for driving the suction pump 264 for suction. A suitable pressure adjusting device (not shown) is used to adjust the suction force of the suction cylinder 148 in advance so that it is weaker than the suction force of the suction nozzle 258. When the belt 308 is driven, and the pulley 276 and the housing 270 are rotated, the planet gears 252 and the disk 254 revolve around the sun gear 250 and rotate about their rotational axes, and the rotary drum 156 is intermittently driven through the end plate 300 so that its rotation is interrupted after every half revolution. When the rotary drum 156 stops its movement, the suction nozzle 258 strongly draws and holds the uppermost thin sheet 14*c* placed on the holding base 140 to the surface of the rotary drum 156 by the suction holes 256 located 3–8 mm to the left of the wall 258*a* (FIG. 15). Thus, when the rotary drum 156 rotates past the temporary interrupting point, the thin sheet 14*c* is clamped between the belts 172, 173, 174 and 175 shown in FIGS. 10 and 15 to be shifted to the left side. In this case, when a thin sheet immediately under the uppermost thin sheet 14*c* is drawn by suction therewith and begins to be shifted, since the suction holes 256 at the side of the rotary drum 156 are covered with the thin sheet 14*c*, the thin sheet is drawn by suction to the lower position of FIGS. 10 and 15 by the suction cylinder 148 to be attached to the plate 150. Thus, the uppermost thin sheet 14*c* alone continues to shift to a predetermined position. When the rotary drum 156 stops at the next interrupting point, the thin sheet attached to the plate 150 is drawn and held by suction to the rotary drum 156 with a suction force greater than that of the suction cylinder 148. When the suction holes 256 pass the wall 258*b* of FIG. 15 and the rotary drum 156 rotates further, the thin sheet is released from its front end and from the suction force of the suction holes 256, and it leaves the circumference of the rotary drum 156. The thin sheet is then shifted deep into the clamping port 182 of FIGS. 10 and 15 and clamped between the belts 172, 173 and 174, 175 to be fed to a predetermined position. The number and arrangement of the suction holes 152 formed in the plate 150 of the suction cylinder 148 may be selected depending on each particular apparatus. In FIGS. 10 and 15, a suction cylinder, as shown in FIG. 17 in an enlarged scale, is used wherein suction holes 152 are formed in a matrix form: 5 in number laterally, and 3 in number longitudinally. The number of the laterally aligned suction holes 152 is determined by the lateral width of the thin sheets, and the number n of the longitudinally aligned suction holes 152 is so determined that a sequential feeding of the thin sheets, one at a time, is possible even if the rotary drum initially draws by suction uppermost thin sheet 14*c* as well as extra paper sheets which are n in number. Thus, FIG. 17 illustrates a case wherein n is 3. The operation under such circumstances will be described.

In FIG. 15, 4 thin sheets from and including the uppermost thin sheet will be referred to as the first, the second, the third, and the fourth thin sheet. The lateral arrays of the suction holes will be referred to, from the right, as the first, the second and the third array of the suction holes 152 which are bored through the plate 150 of the suction cylinder 148 and are aligned, 5 in the lateral direction, and 3 in the longitudinal direction. When the first four of the thin sheets are drawn by suction by the rotary drum 156, the first thin sheet is strongly drawn by suction to the rotary drum 156 and displaced to the left of FIG. 15. Since the suction holes 256 are covered by the first thin sheet, the second, the third and the fourth thin sheets are displaced with the first thin sheet mainly by friction. When the second, the third and the fourth thin sheets reach above the first array of suction holes 152, the first thin sheet is drawn by suction to the first array of suction holes 152 to cover them. The second and third thin sheets are shifted to the left with the first thin sheet. When the third thin sheet reaches above the second array of suction holes 152, the third thin sheet is drawn by suction to the second array of suction holes 152 to cover them. Thereafter, the second thin sheet alone is shifted to the left with the first thin sheet and is then drawn by suction to the third array of suction holes 152 as may be apparent from the above description. Thereafter, only the first thin sheet, that is, the uppermost thin sheet 14*c* continues to be fed to the cramping port 182. Upon each half rotation of the rotary drum 156, the second, the third, and the fourth thin sheets are sequentially fed to the cramping port 182. It is to be understood that further thin sheets are sequentially drawn by suction and fed in a similar manner, so no attempt at further explanations will be made. Even when n takes other values, the thin sheet are sequentially fed from the uppermost thin sheet in a similar manner.

The description of the thin sheet feeding means 154 having the rotary drum 156, the differential gear 240, the hollow annular body 260, the hollow stationary shaft 262, the suction pump 264 and the housing 270 is finished. The operation of the apparatus of this invention will now be described.

First the motor 134 is driven to lower the holding base 140 to its lowest position, and the pile 14, that is, the thin sheets **14*b* bundled by the belt member 14*a*, is placed on the holding base 140. Next, the motor 305 is driven to drive the belts 172, 173, 174 and 175 respectively, in the directions of the arrows 176 and 178 for rotating the rotary drum 156 in the direction of the arrow 160. The motor 212 (FIG. 11) and the motor 134 are driven to start lifting the holding base 140 and to start operating the suction pumps 153 and 164**.

Since the position detector 147 is not in contact with the uppermost thin sheet **14*c* under these conditions, the motor 134 continues to rotate and gradually lifts the holding base 140. As the holding base 140 is lifted, the pile 14 is lifted, and the longitudinal side faces 20 of the pile contact the outer circumferences of the rollers 198 and 200. The portions which are making contact are driven by the motor 212 to move upward at a speed faster than that of the holding base 140. Both of the longitudinal side faces 22 are frictionally lifted by the rollers 198 and 200. The motor 212, the shaft 206, the worms 208 and 210, and the worm wheels 202 and 204 constitute the roller driving mechanism 201 for rotating the rollers 198 and 200. The pile 14 is thus curved to be upwardly recessed as shown in FIG. 11. As in the case of the first embodiment, a space 108 similar in shape to a convex lens (FIG. 11) is formed between the belt 14*a* and the uppermost thin sheet 14*c*. Thus, it will be extremely easy to sequentially pull out the thin sheets in the longitudinal direction of FIG. 11. As indicated before, the rollers 198 and 200, and the roller driving mechanism 201 constitute the bending means 203** for bending the pile.

When the pile 14 is curved and is further lifted in accordance with the lifting of the holding base 140, causing the thin sheet **14*c* to contact the position detector 147, the motor 134 is temporarily stopped. The thin sheet feeding means 154, as indicated before, is driven by the belt 308 through the pulley 276, and intermittently rotates the rotary drum 156, interrupting its rotation at each half cycle. As already described with reference to the thin sheet feeding means 154, the thin sheets placed on the holding base 140 are shifted by the means 154, starting with the uppermost thin sheet 14*c* clamped between the belts 172, 173, 174 and 175, and fed to a predetermined position. When the position detector 147 leaves the thin sheet, in response to this action the motor 134 is driven again to lift the next uppermost thin sheet to a predetermined position where the position detector operates to interrupt the motor 134 to stop the lifting of the holding base 140. In repeating the above operation, all of the thin sheets 14*b* on the thin sheet holding base 140** are fed to the outside.

Accordingly, with apparatus in accordance with both embodiments of this invention, the thin sheets **14*b* can be easily fed without removing in advance the belt member 14*a* from the pile 14, by curving the pile 14 bundled by the belt member 14*a***.

FIG. 12 shows a third embodiment of this invention. The embodiment is similar to the second embodiment (FIG. 11), except for the structure of the curving means 203 for curving the pile 14 so that it is recessed upwardly. In this third embodiment, rollers **198*a* and 200*a* have diameters smaller than those of rollers or driven rollers 198 and 200 and are parallel thereto. The rollers 198 and 198*a* are connected by a belt 198*b*, and the rollers 200 and 200*a*, by a belt 200*b*. The rollers 198, 200, 198*a* and 200*a* and the belt 200*b* constitute a belt means 205. The pile 14 is supplied from below the rollers 198*a* and 200*a*, and its side faces are lifted by the belts 198*b* and 200*b***, deforming it into a recessed shape.

Typical apparatus of this invention were described with particular reference to the above three embodiments. This invention can be applied to an apparatus wherein the piles 14 are superposed and set on the vertical holding base in the horizontal direction. In the embodiment of FIGS. 11 and 12, a thin sheet feeding means 154 is used which rotates the rotary drum 156 and intermittently interrupts each shaft rotation. When working conditions permit, a continuous type thin sheet feeding means may be used instead of an intermittent type rotary drum such as the feeding means 154. The above-mentioned three embodiments has referred to the case where the pile of thin sheets is totally so bent as to be concaved from above. According to the conditions such as the thickness of such pile, etc., moreover, it is possible to bend only part of the upper side of the pile and, as explained above, sequentially feed the thin sheets of such partial pile one at a time from the uppermost one. In this case, since the remaining thin sheets of the pile are not in a state of having been firmly bundled by the belt member, they can be easily fed without being bent whatsoever.

What is claimed as new and desired to be secured by Letters Patent of the United States is:

1. A thin sheet feeding apparatus comprising:

means for supporting a pile of thin sheets bundled by a belt member;

means for moving said pile in a predetermined direction;

means for bending said pile of thin sheets, said means for bending including means for applying forces to the edges of said pile which are in contact with said belt member, said means for applying forces being adapted to apply forces only in the direction of the plane of said sheets and in said predetermined direction, so that the upper surface of said pile is bent into a concave form and the portion of said band corresponding to said upper surface separates from said upper surface while remaining in contact with said edges of said pile; and means for sequentially feeding at least the uppermost thin sheet of said pile in a second predetermined direction, said uppermost thin sheet being on the concave side of the pile.

2. An apparatus according to claim 1, wherein said bending means includes a curved surface forming means for creating a space between said uppermost thin sheet and said belt member.

3. An apparatus as set forth in claim 1, wherein said pile moving means has a base plate on which is placed said pile and which may be moved vertically; and means for interrupting the operation of said moving means when said base plate reaches either of the predetermined limits of displacement.

4. An apparatus according to claim 3, wherein said means for applying forces includes at least one pair of sandwiching members for sandwiching said pile therebetween while pressing those two opposed end faces thereof which are in parallel with a direction in which the thin sheets of said pile are piled up, and a stopper which, at the time when said pile is bent in accordance with the sandwiching operation of said sandwiching members, serves to specify the direction in which said pile is bent; and wherein said feeding means is so formed as to sequentially feed said thin sheets one at a time from a concaved side of said bent pile.

5. An apparatus as set forth in claim 4, wherein said sandwiching means includes two side plates which are mounted at both sides of the pile placed on said pile moving means, these sides being substantially perpendicular to said direction of feeding, and which are mounted in opposition to each other with respect to said supporting means for pivotal movement about axes extending in said direction of feeding, and means for pivoting said side plates whereby said pile is curved by said pivoting of said side plates such that its recessed surface faces upwardly.

6. A thin sheet feeding apparatus comprising:

(a) a supporting means for supporting a pile of thin sheets bundled by a belt member;

(b) a main mechanism of the feeding apparatus which is so provided as to oppose said pile of thin sheets supported by said supporting means, thereby to sequentially feed the thin sheets of said pile one at a time from the uppermost thin sheet;

(c) pile shifting means for gradually causing said supporting means to approach said main mechanism of the feeding apparatus so as to maintain the relation in position between said main mechanism and said uppermost thin sheet in a predetermined positional relation; and (d) bending and maintaining means for bending said pile placed on said supporting means and maintaining said pile at its bent state, the bending of said pile being effected by rubbing those two opposed side faces of said pile which are both in parallel with a direction of feeding of said thin sheets and in parallel with a direction of piling the same, at a speed higher than a speed at which said supporting means approaches said main mechanism, and in alignment with a direction in which said supporting means approaches said main mechanism and in such a manner as to cause a gradual increase in frictional force between each element of said bending and maintaining means and a corresponding one of said two opposed side faces of said pile.

7. An apparatus as set forth in claim 6, wherein said bending and maintaining means has two rollers disposed substantially parallel to each other in the direction of feeding of said thin sheets, which are spaced apart by a distance smaller than the width of said pile, the width being in the direction perpendicular to said direction of feeding; and roller driving means for rotating said two rollers in opposite directions in contact with the side faces of the pile which are substantially parallel to said rollers and in the direction so as to displace said side faces toward the other side of a plane, the pile being supplied between said two rollers from one side of said plane by said pile shifting means so that the uppermost thin sheet is substantially parallel to said plane which includes the central axes of said rollers.

8. A thin sheet feeding apparatus according to claim 6, wherein said bending nd maintaining means includes a pair of belt means which are disposed respectively on two opposed sides of said pile at an interval smaller than the width of said pile taken in a direction substantially at right angles to said direction of feeding and which contact said two opposed sides of said pile to move it, in frictional contact with it, at a speed higher than that at which said pile is shifted, and in a direction the same as that in which said pile is shifted, said pair of belt means having a pair of driven rollers, a pair of rollers free of rotation respectively in corporating relationship with said pair of driven rollers and a pair of belts each stretched over one said driven roller and one corresponding roller free of rotation, and roller driving means for driving said pair of driven rollers.

9. A thin sheet feeding method comprising the steps of:

(a) moving a pile of thin sheets bundled by a belt member and maintaining the uppermost thin sheet of the sheet pile at a predetermined level;

(b) applying forces on both parallel side faces of the sheet pile so bundled, bending said pile to cause the uppermost thin sheet to be spaced apart from the belt to permit a space to be created therebetween, and maintaining the pile at its bent configuration; and (c) feeding one sheet at a time from the uppermost thin sheet side of the sheet pile in a predetermined direction.

* * * * *